US005440196A

United States Patent [19]

Gleixner

[11] Patent Number: 5,440,196

[45] Date of Patent: Aug. 8, 1995

[54] DUAL-ENVELOPE HIGH-PRESSURE DISCHARGE LAMP CONSTRUCTION, AND METHOD OF ITS MANUFACTURE

[75] Inventor: Karl-Heinz Gleixner, München, Germany

[73] Assignee: Patent-Treuhand-Gesellschaft F. Elektrische Gluehlampen MBH, Munich, Germany

[21] Appl. No.: 101,180

[22] Filed: Aug. 3, 1993

[30] Foreign Application Priority Data

Sep. 15, 1992 [DE] Germany ..... 4230815

[51] Int. Cl.[6] ..... H01J 61/34

[52] U.S. Cl. ..... 313/25; 313/252; 313/261

[58] Field of Search ..... 313/25, 26, 252, 261, 313/292, 634, 572, 573; 445/23, 26, 44

[56] References Cited

U.S. PATENT DOCUMENTS

| | | | |
|---|---|---|---|
| 2,267,090 | 12/1941 | Freeman | 313/25 |
| 3,407,123 | 10/1968 | Peterson | 313/634 |
| 4,479,071 | 10/1984 | T'jampens et al. | 313/25 |
| 4,843,266 | 6/1989 | Szanto et al. | 313/25 |
| 4,866,327 | 9/1989 | Fischer et al. | 313/25 |
| 4,868,449 | 9/1989 | Dunn et al. . | |
| 5,023,506 | 6/1991 | Canale et al. . | |
| 5,039,912 | 8/1991 | Van Vliet et al. | 313/634 |
| 5,075,586 | 12/1991 | Jaeger et al. | 313/25 |
| 5,252,885 | 10/1993 | Muzeroll et al. | 313/25 |

FOREIGN PATENT DOCUMENTS 0381279 8/1990 European Pat. Off. .

OTHER PUBLICATIONS

Patent Abstracts of Japan, vol. 13, No. 8 (E-702) (3356) Jan., 1989, JP-A-63 218 146—Matsushita Electronics Corp.

Patent Abstracts of Japan, vol. 13, No. 568 (E861) (3916) Dec., 1989, JP-A-01 236 571 (Matsushita Electronics Corp.

*Primary Examiner*—Sandra L. O'Shea
*Assistant Examiner*—Vip Patel
*Attorney, Agent, or Firm*—Frishauf, Holtz, Goodman & Woodward

[57] ABSTRACT

To facilitate manufacture of a high-pressure discharge lamp in which a double-ended discharge vessel is located within an outer, essentially rotation-symmetrical bulb (1), the holder structure for the discharge vessel is formed of first and second punched sheet-metal elements (12*a*, 12*b*; 20, 21) which define surface planes, and are electrically separate from each other. A first punched sheet-metal (12*a*, 20) is electrically connected to a first current supply lead (*7a*) from the discharge vessel and a first current connector (11*a*) extending from the base. A second punched sheet-metal element (12*b*, 21) is electrically connected to the second current supply lead (*7b*) and the second current connector (11*b*, 11*b'*) extending from the base. Both punched sheet-metal elements are located essentially in a central plane, and extend essentially perpendicularly with respect to the lamp axis (I—I). The upper one of the punched sheet-metal elements can be formed with an extending tab or blade, terminating in a holding ring which surrounds an inwardly extending projection formed in the dome of the discharge vessel. The punched sheet-metal elements (12*a*, 12*b*; 20, 21) are parts of a two-part frame, severed from a unitary frame (10, 10') which, with the current supply leads (*7a*, *7b*) and a protective quartz-glass tube and centering strips therefor—if used—forms a stable subassembly for welding to the current connectors.

15 Claims, 4 Drawing Sheets

DUAL-ENVELOPE HIGH-PRESSURE DISCHARGE LAMP CONSTRUCTION, AND METHOD OF ITS MANUFACTURE

Reference to related patent, assigned to the assignee of the present application, the disclosure of which is hereby incorporated by reference: U.S. Pat. No. 5,075,586, Jaeger et al.

Reference to related application, assigned to the assignee of the present application, the disclosure of which is hereby incorporated by reference: U.S. Ser. No. 08/101,181, , filed Aug. 3, 1993, GLEIXNER et al.

FIELD OF THE INVENTION.

The present invention relates to a high-pressure discharge lamp, and more particularly to a high-pressure discharge lamp in which a discharge vessel is located within an outer bulb, to thereby form a dual-envelope lamp, especially to a holding or mount construction to retain the discharge vessel within the outer envelope, and to a method of manufacture and assembly of such a lamp.

BACKGROUND.

The referenced U.S. Pat. No. 5,075,586, Jaeger et al, assigned to the assignee of the present application, the disclosure of which is hereby incorporated by reference, illustrates a lamp of the type to which the present invention relates. The lamp of the referenced Jaeger et al patent has a double-ended arc tube or discharge vessel within an outer bulb. A sheet-metal guide element is secured to a support rod of a holder structure which extends within the bulb. The sheet-metal part has a major surface extending at least approximately transversely to the lamp axis. It is formed with an opening fitting around and loosely, resiliently receiving a press seal of the arc discharge tube. The lamp holding structure is made in two parts, and is formed, essentially, of a U-shaped bent holder which is connected, for example welded, with one current connector extending from the base mount. A metallic support rod, extending parallel to the lamp axis, is connected, for example welded, to a second current connector leading from the base mount. A cross element connects this second current supply connector to the second current supply lead extending from the distal end of the double-ended discharge vessel. The metallic support rod terminates in a ring segment positioned transversely to the axis of the lamp, and engaging the inner wall of the outer bulb somewhat below the dome-shaped cap of the outer bulb.

The metallic rod as well as the mount connector are made of metallic wire or rod material. An additional guide element is provided to improve the resistance of the lamp with respect to vibration and shock. The guide element is secured to the metallic rod, and is formed of a punched sheet-metal element located in a plane transversely to the axis of the lamp. It engages a pinch seal of the discharge vessel in a clamp connection.

The construction and operation of this lamp is excellent; the manufacturing costs, however, are considerable since different elements have to be connected and wire material has to be bent and shaped quite accurately.

THE INVENTION

It is an object to simplify the manufacture of such a lamp by developing a construction which is easy to make and inexpensive to produce under mass production conditions without detracting from the efficiency and efficacy of the overall lamp.

Briefly, the holder is constructed of a generally shallow U-shaped sheet-metal frame which, after the respective leg portions of the frame are connected to current supply leads from the discharge vessel, is severed to form two punched sheet-metal elements which are electrically separate, that is, insulated from each other by a space. The sheet-metal elements are located in a plane such that a theoretical line perpendicular to the surface plane of the sheet-metal elements extends at a right angle with respect to the lamp axis. The leg portions of the frame, i.e. the first and second sheet-metal elements, after attachment to the current supply leads, extend at an angle, and usually and preferably at an essentially right angle with respect to the lamp axis.

The high-pressure discharge lamp, thus, has a mount to hold the discharge vessel within an outer bulb which includes the two electrically insulated punched sheet-metal elements which, in a preferred embodiment, are punched from an essentially U-shaped frame. In accordance with a preferred embodiment, the U-shaped frame, severed into two parts, essentially reaches around one or more additional inner protective sleeves, made of a highly light-transmissive material, and functioning as protection in case of rupture of the discharge vessel.

Use of punched sheet-metal elements in the discharge vessel mount permits efficient and inexpensive manufacture of the holder structure for the lamp. Additionally, it substantially facilitates centering and alignment of the discharge vessel within the outer bulb. Typically, the outer bulb carries one or more base connections, for example a screw-in base, and can be adapted for placement in an optical system, for example in a reflector. Thus, the position of the discharge vessel within the outer bulb is important. The punched sheet-metal elements further increase the stability and carrying or loading capacity of the lamp mount as a whole, which is particularly important if the additional inner protective shield tubes or sleeves, providing rupture or explosion protection for the discharge vessel, are used.

DRAWINGS

DETAILED DESCRIPTION.

The invention will be described with respect to metal halide vapor high-pressure discharge lamps having a power rating of between about 35 W and 150 W. The length of the lamp, in either embodiment, is about 138 mm, and the maximum diameter of the outer bulb approximately 54 mm.

Figure 1:
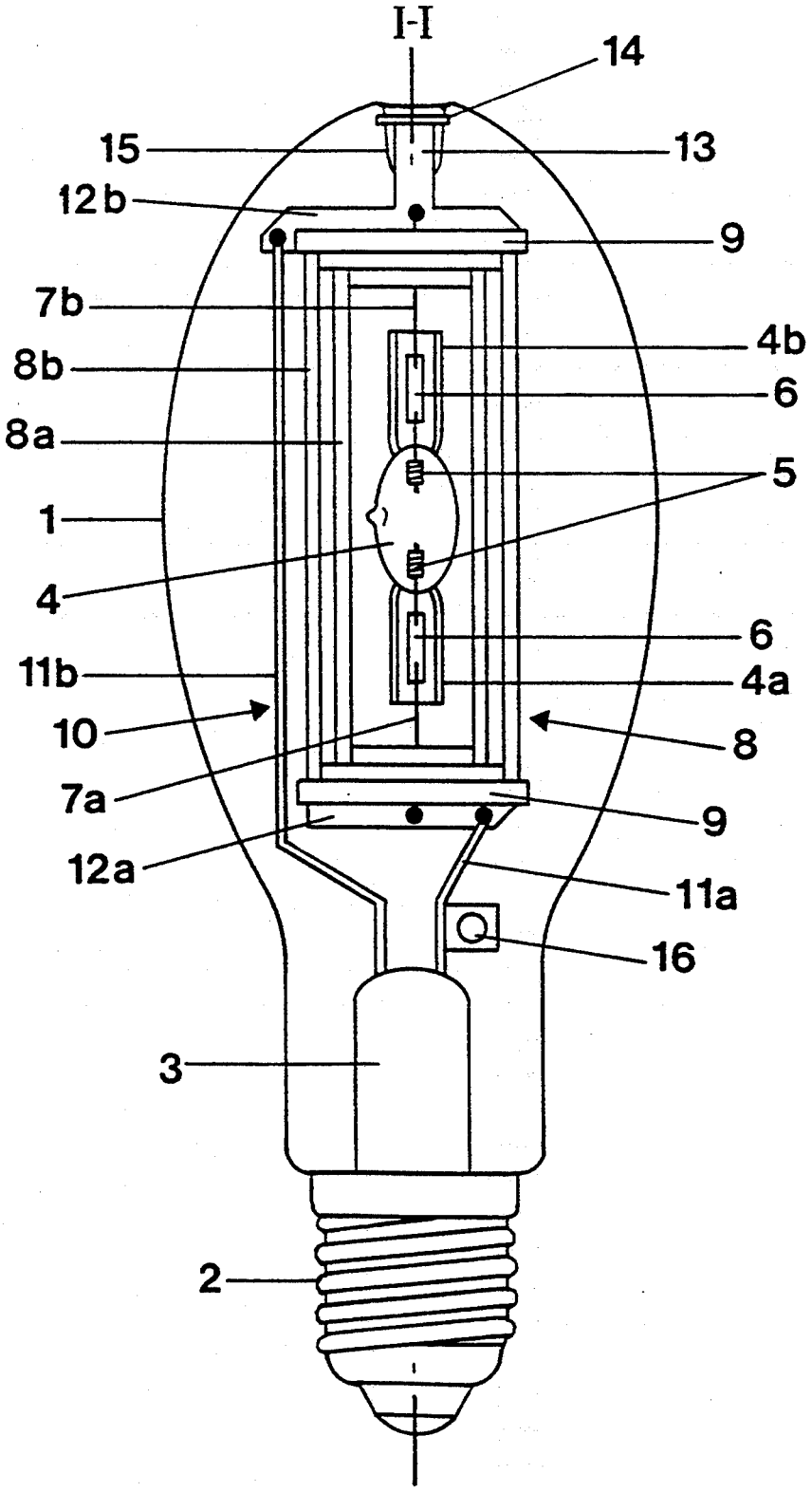
FIG. 1 is a side view of a single-based high-pressure discharge lamp in a accordance with the present invention.
Figure 4:
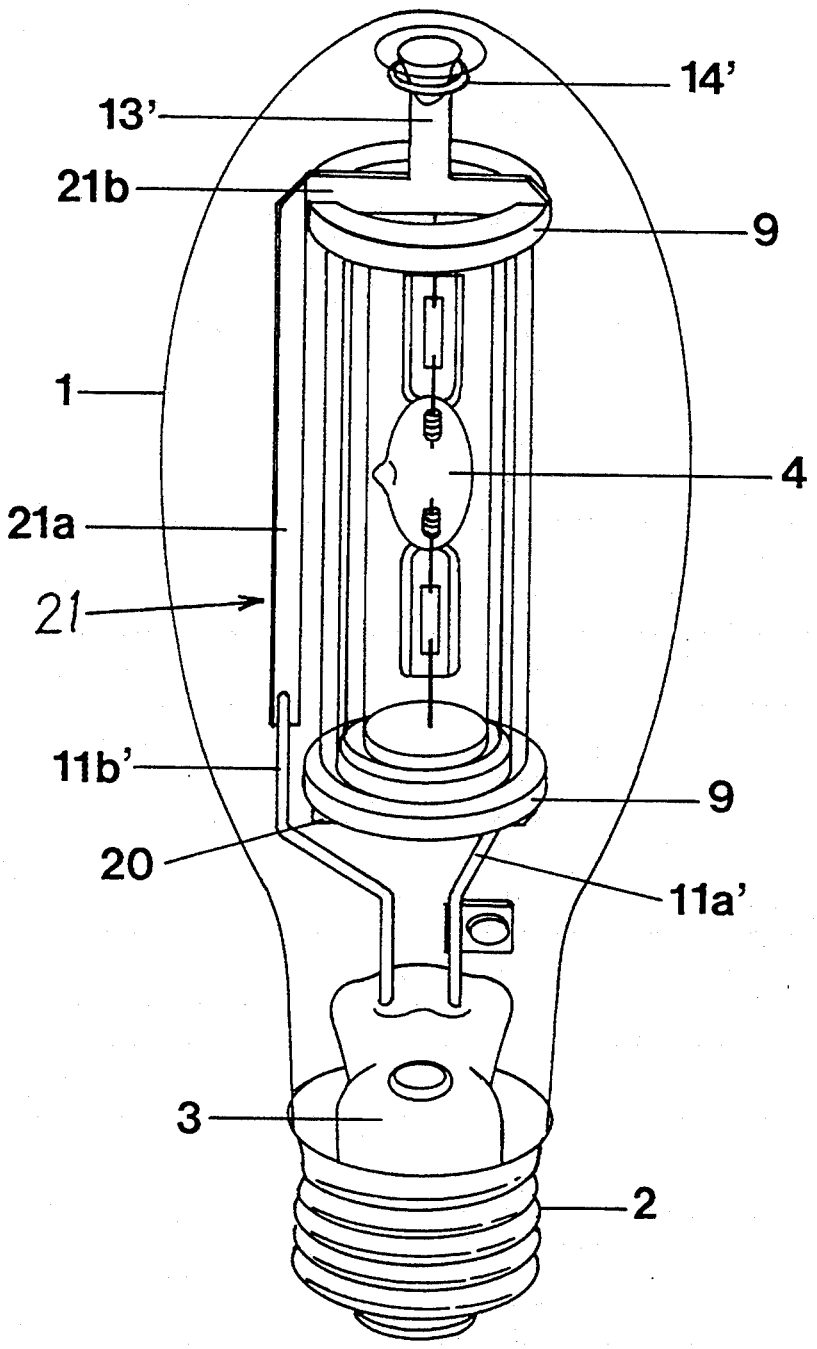
FIG. 4 is a perspective view of the lamp, also illustrating the interior arrangement.

FIG. 1 and 4 illustrates a first embodiment of the high-pressure discharge lamp in accordance with the present invention. An essentially rotation-symmetrical outer bulb 1 is connected at one end to a screw-type base 2. Internally, the lamp has a mount 3 in form of a projecting flare mount.

The light source is formed by a double-ended sealed axially aligned discharge vessel 4 of quartz glass, having an ionizable fill, and two electrodes 5 located therein. They are gas-tightly sealed into the discharge vessel. The discharge vessel 4 has, with respect to the base 2, a proximate pinch seal 4*a* and a distal pinch seal 4*b*. Each pinch seal retains a molybdenum foil 6, melt-sealed therein, and connected respectively to the electrodes. A first current supply lead 7*a* extends through the proximate pinch seal 4*a*; a second current supply lead 7*b* extends from the distal end of the distal pinch seal 4*b*. The current supply leads 7*a*, 7*b* are electrically connected to the respective molybdenum foils 6 within the pinch seals 4*a*, 4*b*, respectively.

Preferably, but not necessarily, a double-wall cylindrical protective body 8 surrounds the discharge vessel 4 throughout its entire length. The protective body 8 is cylindrical and light-transmissive, and formed of two glass tubes 8*a*, 8*b*. The glass for the glass tubes 8*a*, 8*b* is quartz glass. To align the protective body 8 in position, two centering elements 9 are provided, extending along a ring diameter. The glass tubes 8*a*, 8*b* are seated on the centering element and engage facing surfaces thereof. The centering elements 9 preferably are made of ceramic.

A two-part metallic lamp holder 10 secures the discharge vessel 4, the protective body 8 and the centering elements 9 in position. The holder 10 further includes two current connectors 11*a*, 11*b* which are melt-sealed in the mount 3.

In accordance with a feature of the invention, the lamp holder 10 includes two punched sheet-metal elements 12*a*, 12*b*. A first sheet-metal element 12*a* is electrically and mechanically connected with the first current connector 11*a* and with the proximate lamp current supply lead 7*a*. The connection, preferably, is by welding. The second punched sheet-metal element 12*b* is connected to a second elongated current connector 11*b*, extending towards the outer bulb and then parallel to the discharge vessel, and, further, to the second current supply lead 7*b* from the discharge vessel. The electrical and mechanical connection, preferably, is by welding. The current supply leads 7*a*, 7*b* are passed, respectively, through a central bore in the respective centering element 9. Both punched sheet-metal elements 12*a*, 12*b* extend, like webs, transversely to the lamp axis I—I. The sheet metal used is, preferably, nickel sheet, with a thickness of about 0.3 mm. The sheet-metal defines a plane, and a theoretical line extending perpendicularly to that plane is, in turn, perpendicular to the lamp axis I—I. The sheet-metal elements 12*a*, 12*b* are located in a single plane. The centering elements 9 are formed with slots 9*b* (see FIG. 3) into which the sheet-metal elements 12*a*, 12*b* can engage. The slots and the sheet-metal elements are matched to each other to form a matched fit. The sheet-metal elements, through the centering element 9, press the centering element against the glass tubes 8*a*, 8*b* of the protective body 8.

The second sheet-metal element 12*b* has an extending strip or tab or blade 13 formed thereon which ends in transversely extending portions capable of being bent into ring shape to form a ring-shaped holder 14, engaging around an inwardly extending projection or dimple 15 of the dome of the outer bulb 1. Thus, the lamp holder 10 is securely retained in position within the outer bulb. A getter 16 is located within the outer bulb 1, connected to the current connector 11*a*, at a position beyond the extension of the current connector 11*a* from the mount 3.

Figure 2:
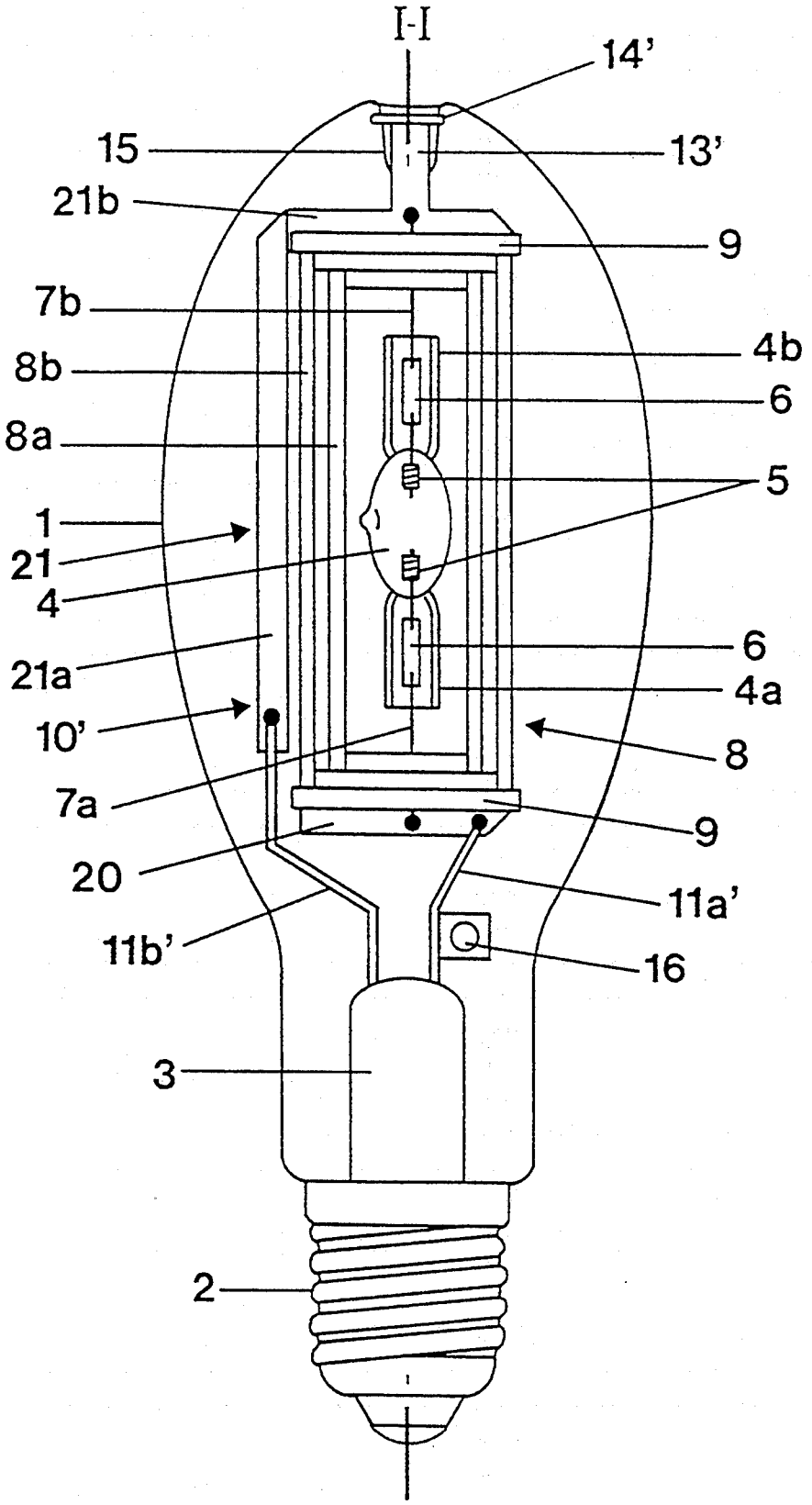
FIG. 2 is a view similar to FIG. 1 and illustrating another embodiment.

FIG. 2 illustrates another embodiment which, generally, is similar to that of FIG. 1, and identical parts have been given identical reference numerals, and similar parts the same numbers with prime notation. The difference between the embodiment of FIG. 2 and that of FIG. 1 resides essentially only in the lamp holder 10′. In all other details, the embodiments are identical.

The lamp holder 10′ in the embodiment of FIG. 2 has current connectors 11*a*′, 11*b*′, melt-sealed in the base mount 3 It includes two punched sheet-metal elements 20, 21. The first sheet-metal element 20 is welded to the first current connector 11*a*′ and to the first proximate lamp current supply lead 7*a*. This first sheet-metal element 20 is formed as a strip element extending at right angles to the lamp axis I—I.

The second punched sheet-metal element 21 is angled and has two leg portions. One leg portion 21*a* extends parallel to the lamp axis I—I, and the other leg portion 21*b* extends at right angles thereto. The transversely extending leg portion 21*b* is welded to the distal current supply lead 7*b* extending from the discharge vessel. It, further, has a strip 13′ formed thereon which carries a holder portion 14′, securing the sheet-metal part 21 on an internally extending projection 15 in the outer bulb. The leg 21*a* extending parallel to the lamp axis 1 is welded at a lower portion thereof to the second current connector 11*b*′, projecting from the base mount 3. The leg 21*a* extends parallel to the outer wall of the outer glass tube 8*b* of the protective body 8 towards the lamp base 2. It terminates somewhat above the end of the protective body 8 at the proximate side thereof, so that, when a high-voltage pulse to ignite the lamp is applied, arc-over to the first punched sheet-metal element 20 is effectively prevented.

Both sheet-metal elements 20, 21 have a thickness of about 0.3 mm and are located in the same plane. Their major surfaces intersect or are parallel to the lamp axis I—I; in other words, a theoretical line extending from the plane of the major surfaces will be perpendicular to the axis I—I. Thus, the lamp axis I—I is parallel to the upper side and the lower side of the punched sheet-metal elements 20, 21.

The punched sheet-metal elements 20, 21 form a two-part essentially U-shaped frame which essentially surrounds the protective body 8 and the discharge vessel 4 from three sides. Of course, there is no electrical connection between the two punched sheet-metal elements 20, 21, and the frame forms a gap between the free end of the leg 21*a* extending parallel to the lamp axis I—I and the first punched sheet-metal element 20.

The legs 21*b* as well as the legs 20 fit into slots 9*b* formed in the centering elements 9.

The centering elements 9 may be of any suitable shape, for example a transversely extending rib, a wheel-like arrangement with spokes, a spider, or the like. The centering elements 9 are formed with stepped abutments 9*a* against which the protective tubes 8*a*, 8*b*, respectively, fit.

Figure 3:
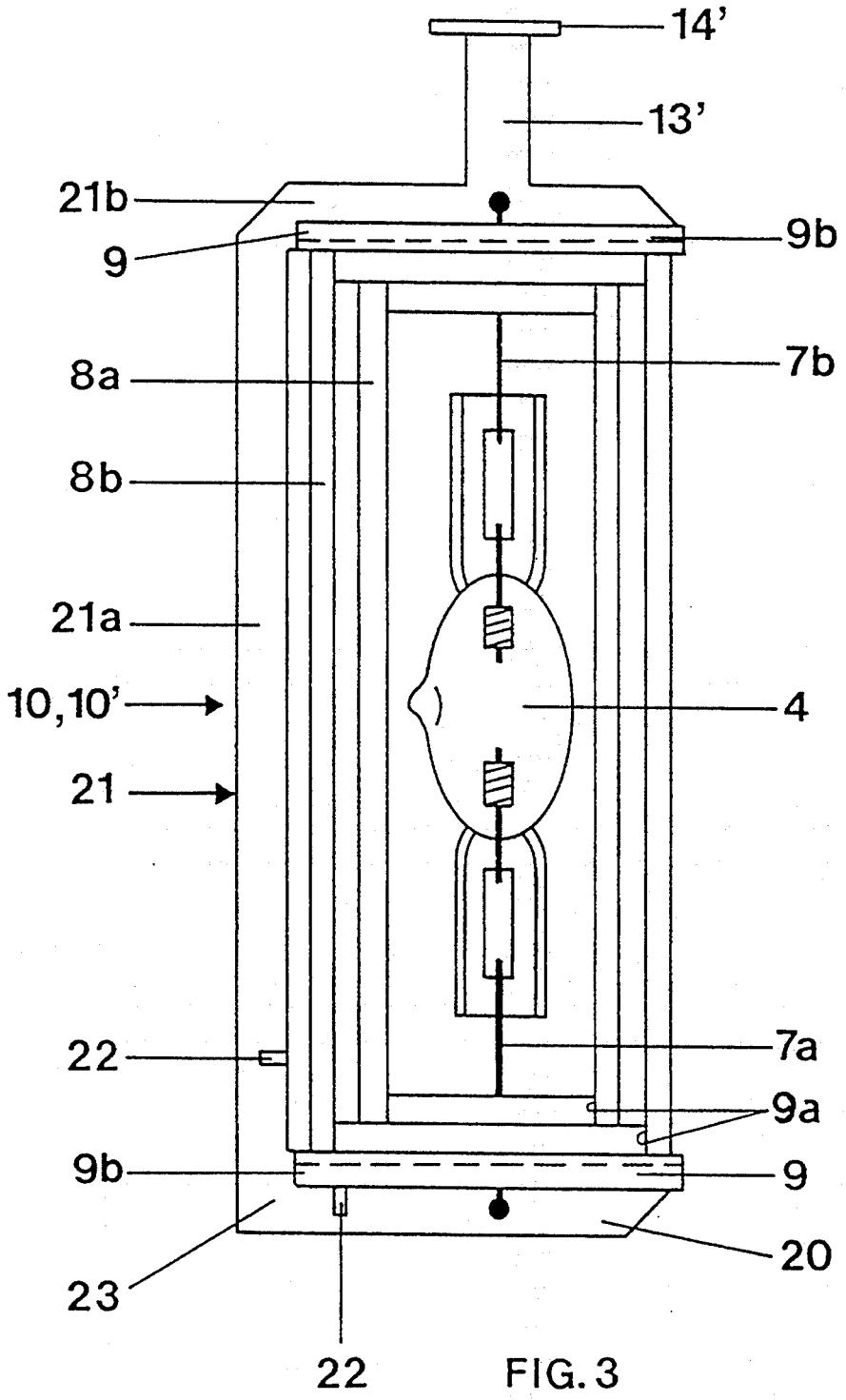
FIG. 3 illustrates a subassembly used in the embodiment of FIG. 2 before introduction into the outer bulb and before severing the legs of the U-shaped frame electrically and mechanically from each other.

The manufacture of the lamp in accordance with the present invention is highly simplified. Referring, now, to FIG. 3, which shows the discharge vessel 4, with the protective body 8, and a unitary punched sheet-metal frame 10 or 10′, before assembly in the outer bulb 1.

First, a punched sheet-metal frame 10, 10′ is made, preferably of nickel sheet metal having a thickness of about 0.3 mm. This frame is punched from a sheet in form of a unitary, essentially shallow U-shaped structure. The frame 10, 10' has the general shape of a rectangle from which one of the two longitudinal sides is missing, having been punched out. The frame has a straight portion 21*a* and two legs 20, 21*b* extending from the straight portion 21*a* in the same direction, and being angled off therefrom by 90°. All frame portions 21*a*, 20 and 21*b* are in a single plane. The two legs 20, 21*b* are shorter than the straight portion 21*a*. The leg 21*b* is additionally formed with a strip or flap or, generally, an extension 13', extending outwardly from the frame and is located in the plane of the frame The extension 13' terminates in a holder portion 14', likewise located in the plane of the frame.

Two cylindrical glass tubes 8*a*, 8*b* are then fitted over the discharge vessel 4. The discharge vessel 4 can be made in accordance with any well known standard process, and can be a stock item. The cylindrical glass tubes 8*a*, 8*b* surround the discharge vessel 4 throughout its entire length. The current supply leads 7*a*, 7*b*, extending from the discharge vessel 4, are threaded through a centrally located reception bore of the centering element 9, so that the centering element 9 engages the end faces of the glass tubes 8*a*, 8*b*. Interengaging elements such as shoulders 9*a*, holding stubs, ridges, grooves or the like, can be formed in the centering element 9 to securely position the glass tubes 8*a*, 8*b*. Preferably, and most simply, the centering elements 9 are formed with stepped shoulders 9*a*, fitting into the open ends of the glass tubes 8*a*, 8*b*, to center the glass tubes so that they extend coaxially with respect to the discharge vessel 4. The two glass tubes 8*a*, 8*b* form a transparent, highly light-transmissive double-wall protective surrounding body 8 for the discharge vessel 4.

A subassembly is thus made, which includes a discharge vessel 4, the protective body 8 and the centering elements 9. This subassembly is located between the angled-off legs 20, 21*b* of the frame 21 in such a manner that the wall of the body 8 and the discharge vessel 4 are parallel to the straight portion 21*a* of the frame 21. The two angled-off legs 20, 21*b* are located in the slots 9*b* at the free or outer sides of the centering elements 9 and press the centering elements with their inner side against the facing ends of the glass tubes 8*a*, 8*b* of the protective body 8, and spece the inner glass tube 8*a* from the discharge vessel 4 (see FIG. 1).

A first, for example the proximate current supply 7*a*, is now electrically and mechanically connected with the leg 20, typically by welding. The distal current supply lead 7*b* is likewise electrically and mechanically connected with the leg 21*b*, for example by welding. The dimensions of the frame are so matched to the dimensions of the discharge vessel 4, the protective body 8 and the centering elements 9, with their slots 9*b* therein, that the centering elements 9 are maintained in their position at faces of the protective body 8 essentially without play, thus stabilizing the entire subassembly.

After welding of the current supply leads 7*a*, 7*b* to the frame 10, 10', the unitary frame 10, 10' is severed into two parts by a laser. The two-part frame 21 is thus formed. Frame 10, 10' has markers 22 which define a corner portion of the frame. Upon cutting the frame 10, 10' with a laser, the corner portion 23 is severed from the frame, so that what is left is the two-part frame with its two electrically separate punched sheet-metal elements 20, 21, which are held in position by the welds of the current supply leads 7*a*, 7*b* to the respective leg portions 20, 21*b*.

The punched sheet-metal element 20, welded to the proximate current supply lead 7*a* extending from the discharge vessel 4, will have the shape of a web or rib or strip extending transversely to the axis I—I of the lamp. The punched sheet-metal element 21 remaining from the frame 10, 10' is in the shape of an angle having a leg 21*a* extending parallel to the lamp axis and a leg 21*b* in form of a web, rib or strip extending transversely to the lamp axis I—I.

After carrying out the manufacturing steps described, the discharge vessel 4, the two punched sheet-metal element frame portions 20, 21, together with the protective body 8 and the centering elements 9, if such a protective body is used, will form a subassembly as a unitary stable structure.

The mount 3, with the current connectors 11*a'*, 11*b'* is made in customary manner, usual in lamp manufacture. The current connector 11*a'* is electrically and mechanically connected, preferably by welding, with the free end of the leg 20. The second current connector 11*b'* is electrically and mechanically connected, preferably by welding, with the leg 21*a* extending parallel to the wall of the protective body 8.

The second subassembly is now ready to be fitted with the outer envelope 1. Before assembling the second subassembly in the outer envelope 1, the projecting strip 13' and the holder 14' are bent out of the plane of the punched sheet-metal frame 21. The ends of the holder strip 14' are bent to partly surround the inwardly extending projecting 15 of the outer envelope. Thus, the strip 13' will form an acute angle with the remainder of the frame, and the ring-shaped plane of the holder 14' will form a right angle with the lamp axis I—I. The lamp axis I—I extends then essentially through the center of the ring-shaped holder 14'. The holder 14' need not be a closed ring.

The discharge vessel 4, with the protective body 8, if used, can then be assembled with the outer bulb 1. Upon assembly, the ring-shaped holder 14' surrounds, at least in part, the inwardly extending projection 15 formed in the closing dome of the outer bulb. The mount at the base, and connection of the base terminals to the current connectors, can then be carried out in customary manner, well known in the lamp manufacturing field.

In accordance with a feature of the invention, the punched sheet-metal elements have a multiple function. They hold the discharge vessel 4, the protective body 8, if used, and further provide current supply to the discharge vessel, by providing an electrically conductive connection between the respective current connectors 11*a*, 11*b*, 11*a'*, 11*b'* extending from the lamp mount The process of manufacture for a lamp of the embodiment described in connectin with FIG. 1 differs from that above described only in that the severance of the frame 10, 10' will not be done on the corner 23 but, rather, the entire section 21*a* extending parallel to the wall of the protective body 8 is severed. The current connector 11*b* then must be longer, and is welded to the leg 21*b* which is formed upon severing the portion 21*a* of the frame over its entire or at least essentially entire longitudinal extent.

The mount 3 need not be a flare mount as shown; it can be a stem press, or the outer bulb i can be sealed off by a pinch seal or a press seal, in which the current connectors 11*a*, 11*b* are melt-sealed in any suitable and well-known manner.

The glass tubes 8*a*, 8*b*, or at least one of them, of the protective body 8 are made of quartz glass; the centering elements 9 are made of industrial ceramics.

Various changes and modifications may be made, and the invention is not limited to a screw base; a pin connector or a bayonet type or other type of base may be used.

The protective body for the discharge vessel may use only a single glass tube; or in some constructions for some applications, the protective body 8 with one or two or more glass tubes, as well as the centering elements 9, can be eliminated entirely.

The dimensions of the punched sheet-metal elements depend on the dimensions of the discharge vessel 4. It may be necessary, particularly for discharge vessels of power ratings of more than 150 W, to use a thicker sheet metal than that for a smaller lamp to provide sufficient stability when making the lamp holder structure.

The structure may be used also for double-based high-pressure discharge lamps. The only difference in the holder structure then will be that, for a double-based discharge lamp, the extension 13, or 13', respectively, and the ring-shaped holder 14, 14' need not be used. In a double-based high-pressure discharge lamp there would be, of course, two lamp mounts or two pinch seals, respectively.

Various other changes and modifications may be made, and any features described herein in connection with any one of the embodiments may be used with any of the others, within the scope of the inventive concept.

For details and descriptions of various features of the protective body 8 and the centering elements 9, the reader is directed to the referenced copending application assigned to the assignee of this application: U.S. Ser. No. 08/101,181, filed Aug. 3, 1993, GLEIXNER et al.

To increase the stability of the punched sheet-metal elements, it may be desirable in some instances to form the sheet-metal elements with a stiffening ridge, for example by deforming the respective leg along its longitudinal extent with a groove on one side thereof, resulting in a rib or ridge on the other.

I claim:

1. A single-ended high-pressure discharge lamp having an essentially rotation-symmetrical outer bulb (1) defining a lamp axis (I—I), said outer bulb (1) having an end portion remote from the base, which end portion is formed with an inwardly extending projection (15);

at least one base (2) located at an end region of the bulb;

a melt-sealed lamp mount (3) to which said base (2) is secured;

a double-ended discharge vessel (4) having two sealed ends located essentially axially symmetrically within the outer bulb (1);

electrodes (5) located in said discharge vessel, and an ionizable fill in the discharge vessel;

a first current supply lead (7*a*) extending from a first sealed end of the discharge vessel;

a second current supply lead (7*b*) extending from a second sealed end of the discharge vessel;

a holder means (10, 10') for holding the discharge vessel in position in the bulb, said holder means including current connectors (11*a*, 11*b*; 11*a'*, 11*b'*) electrically connected to the at least one base, wherein, in accordance with the invention, the holder means (10, 10') comprises first and second punched sheet-metal elements (12*a*, 12*b*; 20, 21), said punched sheet-metal elements defining surface planes, the first and second punched sheet-metal elements being electrically separate from each other, the first punched sheet-metal element (12*a*, 20) being electrically connected to the first current supply lead (7*a*) and a first current connector (11*a*, 11*a'*), the second punched sheet-metal element (12*b*, 21) being electrically connected to the second current supply lead (7*b*) and a second current connector (11*b*, 11*b'*), both punched sheet-metal elements being located essentially in a single plane;

wherein a theoretical line which is perpendicular to said surface planes of the sheet-metal elements (12*a*, 12*b*; 20, 21) extends at a right angle with respect to the lamp axis (I—I);

a projecting tab or blade (13, 13') formed on the second punched sheet-metal element (12*b*; 21) and extending therefrom;

a holder portion (14, 14'), shaped in ring form, formed on said tab or blade, and clampingly surrounding said inwardly extending projection (15) of the outer bulb (1);

a transparent, hollow cylindrical protective body (8) located within the outer bulb (1), spaced from, and surrounding the discharge vessel (4) over its entire length coaxially with respect thereto; and two spaced centering elements (9) positioned in the lamp and engaged, respectively, by the punched sheet-metal elements (12*a*, 12*b*; 20, 21) of the holder means (10, 10'), said punched sheet-metal elements pressing the centering elements (9) against the end faces of the cylindrical protective body (8).

2. The lamp of claim 1, wherein the first and second punched sheet-metal elements (12*a*, 12*b*; 20, 21) define leg portions (12*a*, 12*b*; 20, 21*b*) positioned at an angle, optionally an essentially right angle, with respect to said lamp axis (I—I).

3. The lamp of claim 1, wherein the holder means comprises a two-part frame, of which the punched sheet-metal elements (20, 21) form part of said frame, said frame essentially surrounding the discharge vessel (4) from three sides thereof.

4. The lamp of claim 1, wherein the first sheet-metal element (12*a*, 20) forms a rib or web extending essentially transversely with respect to the axis (I—I) of the lamp; and wherein the second punched sheet-metal element (21) is of angular form and has an angle portion (21*a*) extending essentially parallel to the axis of the lamp, and a rib or leg portion (21*b*) extending essentially transversely to the axis of the lamp.

5. The lamp of claim 1, wherein the first punched sheet-metal element (12*a*, 20) forms a rib extending essentially transversely with respect to the axis (I—I) of the lamp, said first punched sheet-metal element being electrically and mechanically connected to the first current connector (11*a*, 11*a'*), and further being electrically and mechanically connected to the first current supply lead (7*a*); and wherein the second punched sheet-metal element (12*b*, 21) forms a rib or leg portion extending transversely to the axis of the lamp;

and wherein said second punched sheet-metal element is electrically and mechanically connected to the second current connector (11*b*, 11*b*′) and to the second current supply lead (7*b*).

6. The lamp of claim 5, wherein the electrical and mechanical connection between the respective punched sheet-metal element and the respective electrical connector is a weld connection.

7. The lamp of claim 1, wherein the first sheet-metal element (12*a*, 20) forms a rib or web extending essentially transversely with respect to the axis (I—I) of the lamp;

wherein the second punched sheet-metal element (21) is of angular form having an angle portion (21*a*) extending essentially parallel to the axis of the lamp, and a rib or leg portion (21*b*) extending essentially transversely to the axis of the lamp; and said second current connector (11*b*′) is electrically and mechanically secured to said angle portion, the second current supply lead (7*b*) extending from the second end of the discharge vessel (4) being electrically and mechanically secured to the leg or rib portion (21*b*) extending transversely to the axis of the lamp.

8. The lamp of claim 1, wherein the first punched sheet-metal element (12*a*) comprises a rib or web element extending transversely with respect to the axis (I—I) of the lamp, and is welded to said first current supply lead (7*a*) extending from the first end of the discharge vessel and, further, to the first current supply connector (11*a*), said first current supply connector being melt-sealed in the lamp mount (3);

wherein the second punched sheet-metal element (12*b*) comprises a rib or leg element (12*a*) extending essentially transversely with respect to the axis (I—I) of the lamp, said second punched sheet-metal element being connected to the second current supply lead (7*b*) extending from the second end of the discharge vessel and, further, with the second current connector (11*b*) melt-sealed in the lamp mount, and wherein said second current supply connector (11*b*) is extended longitudinally essentially parallel to said discharge vessel (4).

9. The lamp of claim 1, wherein the punched sheet-metal elements (20, 21) form a two-part frame which surrounds cylindrical the protective body (8) essentially from three sides thereof.

10. The lamp of claim 9, wherein said two parts of the frame are mechanically positively located with respect to each other to retain said protective body (8) in position, but electrically separate from each other.

11. A method to make a high-pressure discharge lamp as claimed in claim 1 said method comprising the steps of punching a unitary punched sheet-metal frame (10) of essentially U-shape, said frame defining an essentially straight portion (21*a*) and two angled-off leg portions (20, 21*b*), said leg portions being located in a single plane;

securing the discharge vessel (4) on the leg portions of the frame, said discharge vessel (4) being positioned to be parallel with respect to said essentially straight portion (21*a*);

electrically and mechanically bonding a first current supply lead (7*a*) extending from the discharge vessel (4) to a first angled-off leg portion (20), and electrically and mechanically bonding the second current supply lead (7*b*) with the second angled-off leg portion (21*b*);

cutting off the essentially longitudinally extending portion (21*a*) of the frame, thereby cutting the electrical connection between the current supply leads (7*a*, 7*b*), and severing the frame into said first and said second punched sheet-metal elements (12*a*, 12*b*);

electrically and mechanically bonding the first current connector (11*a*) with the first angled leg portion forming the first punched sheet-metal element (20) of the frame; and electrically and mechanically bonding the second punched sheet-metal element (12*b*) extending tranversely to the axis (I—I) of the lamp to the second electrical current connector (11*b*).

12. The method of claim 11, including the step of placing a cylindrical transparent protective body (8) around the discharge vessel (4) before electrically and mechanically connecting the current supply leads (7*a*, 7*b*) to the respective punched sheet-metal elements (20, 21*b*);

passing said current supply leads through a central opening of a centering element (9) for positioning the protective body around the discharge vessel;

and then effecting said electrical and mechanical connection.

13. A method to make a high-pressure discharge lamp as claimed in claim 1, said method comprising the steps of punching a unitary sheet-metal frame (10′) of essentially U-shape, said frame defining an essentially straight portion (21*a*) and two angled-off leg portions (20, 21*b*), said leg portions being located in a single plane;

securing the discharge vessel (4) on the leg portions of the frame, said discharge vessel (4) being positioned to be parallel with respect to said essentially straight portion (21*a*);

electrically and mechanically bonding a first current supply lead (7*a*) extending from the discharge vessel (4) to a first angled-off leg portion (20), and electrically and mechanically bonding the second current supply lead (7*b*) with the second angled-off leg portion (21*b*);

severing the essentially longitudinally extending portion (21*a*) of the frame, thereby cutting the electrical connection between the current supply leads (7*a*, 7*b*), and severing the frame into said first and said second punched sheet-metal elements (12*a*, 12*b*);

electrically and mechanically bonding the first current connector (11*a*′) with the first angled leg portion forming the first punched sheet-metal element (20) of the frame; and electrically and mechanically bonding the second current supply connector (11*b*′) to the essentially longitudinally extending frame portion (21*a*), extending parallel to the axis of the lamp.

14. The method of claim 13, including the step of placing a cylindrical transparent protective body around the discharge vessel (4) before electrically and mechanically connecting the current supply leads (7*a*, 7*b*) to the respective punched sheet-metal elements (20, 21*b*);

passing said current supply leads through a central opening of a centering element (9) for positioning the protective body around the discharge vessel;

and then effecting said electrical and mechanical connection.

15. The method of claim 13, wherein said electrical and mechanical bonding step comprises a welding step.

* * * * *